US011633829B2

(12) United States Patent
Lin et al.

(10) Patent No.: US 11,633,829 B2
(45) Date of Patent: Apr. 25, 2023

(54) EXTERNAL HEATING SYSTEM FOR USE IN CHEMICAL MECHANICAL POLISHING SYSTEM

(71) Applicant: Taiwan Semiconductor Manufacturing Co., Ltd., Hsinchu (TW)

(72) Inventors: Yi-Sheng Lin, Taichung (TW); Chi-Hsiang Shen, Tainan (TW); Chi-Jen Liu, Taipei (TW); Chun-Wei Hsu, Hsinchu (TW); Yang-Chun Cheng, Hsinchu (TW); Kei-Wei Chen, Tainan (TW)

(73) Assignee: Taiwan Semiconductor Manufacturing Co., Ltd., Hsinchu (TW)

( * ) Notice: Subject to any disclaimer, the term of this patent is extended or adjusted under 35 U.S.C. 154(b) by 706 days.

(21) Appl. No.: 16/573,957

(22) Filed: Sep. 17, 2019

(65) Prior Publication Data

US 2021/0078129 A1 Mar. 18, 2021

(51) Int. Cl.

| | |
|---|---|
| ***B24B 37/015*** | (2012.01) |
| ***B24B 37/20*** | (2012.01) |
| ***B24B 53/017*** | (2012.01) |
| ***B24B 57/02*** | (2006.01) |
| ***B24B 49/14*** | (2006.01) |

(52) U.S. Cl.

CPC ..... *B24B 37/015* (2013.01); *B24B 37/20* (2013.01); *B24B 49/14* (2013.01); *B24B 53/017* (2013.01); *B24B 57/02* (2013.01)

(58) Field of Classification Search

CPC ..... B24B 37/015; B24B 37/20; B24B 49/14; B24B 57/02

USPC ..... 451/7, 5, 41, 53, 287

See application file for complete search history.

(56) References Cited

U.S. PATENT DOCUMENTS

| | | | | |
|---|---|---|---|---|
| 6,315,635 | B1 * | 11/2001 | Lin | B24B 57/02 451/7 |
| 2003/0104769 | A1 * | 6/2003 | Brunelli | B24B 53/017 451/28 |
| 2006/0226123 | A1 * | 10/2006 | Birang | B24B 49/105 438/692 |
| 2010/0015894 | A1 * | 1/2010 | Ho | B24B 55/02 451/289 |
| 2014/0004626 | A1 * | 1/2014 | Xu | B24B 37/015 257/E21.528 |
| 2014/0231012 | A1 * | 8/2014 | Hinode | H01L 21/6708 156/345.23 |

* cited by examiner

*Primary Examiner* — Joseph J Hail
*Assistant Examiner* — Shantese L Mcdonald
(74) *Attorney, Agent, or Firm* — Seed IP Law Group LLP

(57) ABSTRACT

A chemical mechanical polishing (CMP) system includes a polishing pad configured to polish a substrate. The CMP system further includes a heating system configured to adjust a temperature of the polishing pad. The heating system comprises at least one heating element spaced apart from the polishing pad. The CMP system further includes a sensor configured to measure the temperature of the polishing pad.

20 Claims, 13 Drawing Sheets

EXTERNAL HEATING SYSTEM FOR USE IN CHEMICAL MECHANICAL POLISHING SYSTEM

BACKGROUND

Chemical mechanical polishing (CMP) is widely used in the fabrication of integrated circuits. As an integrated circuit is built up layer by layer, CMP processes are used to planarize the topmost layer or layers to provide a leveled surface for subsequent fabrication steps. CMP processes are carried out by placing a wafer in a wafer carrier that presses the wafer surface to be polished against a polishing pad attached to a platen. Both the platen and the wafer carrier are rotated while a slurry containing both abrasive particles and reactive chemicals is applied to the polishing pad. The relative movement of the polish pad and wafer surface coupled with the reactive chemicals in the slurry allows the CMP process to level the wafer surface by both physical and chemical forces. CMP is an effective way to achieve global wafer planarization for advanced integrated circuits.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1A:
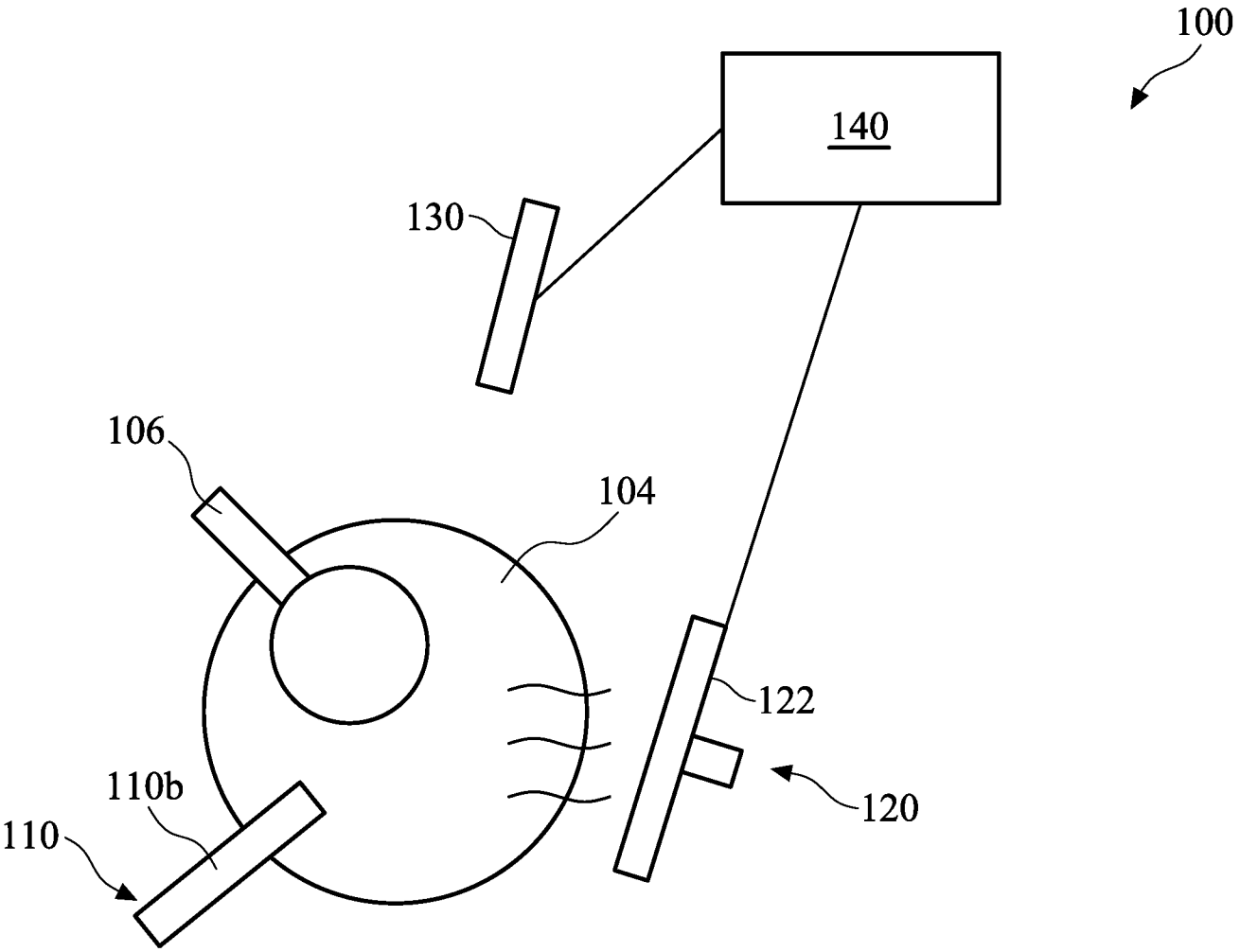
FIG. 1A is a plan view of a chemical mechanical polishing (CMP) system in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Integrated circuits contain numerous devices such as transistors, diodes, capacitors and resistors that are fabricated on and/or in a semiconductor substrate. These devices are initially isolated from one another and are later interconnected to form functional circuits. As device densities in integrated circuits increase, multiple wiring levels are required to achieve interconnections of these devices. CMP processes are commonly used in the formation of multilevel interconnect structures.

In a multilevel interconnect structure, conductive lines (e.g., copper lines) are laid in stacked dielectric layers and are connected through vias from one layer to another layer. The conductive lines and vias are fabricated using single or dual damascene processes in some instances. In such processes, a dielectric layer is patterned to form contact openings including trenches and/or via openings. A barrier layer is deposited along sidewalls and bottom surfaces of the contact openings, followed by depositing a conductive layer over the barrier layer to overfill the contact openings. A CMP process is then performed to remove the overlying conductive layer and barrier layer from the surface of the dielectric layer, thus forming isolated conductive contacts.

A truly uniform polishing, however, is difficult to achieve due to different removal rates (i.e., polishing rates) for different materials in CMP processes. For example, the conductive layer is typically made from a relatively soft metal such as copper, while the barrier layer is made from a relatively hard material such as tantalum and/or tantalum nitride. The conductive layer, thus, is normally polished at a relatively higher rate, when compared to the rate at which the barrier layer is polished. The ratio of the removal rate of conductive layer to the removal rate of the barrier layer is called the "selectivity" for removal of the conductive layer in relation to the barrier layer during the CMP process. When continuing to polish the structure after breaking through the conductive layer, the differences in selectivity of the CMP process to the conductive layer and the barrier layer often cause dishing on the soft metal. The dishing results in surface nonplanarity and thickness variation of interconnect structures across a die area, which negatively affects interconnect performance, causing yield losses. Thus, when making interconnect structures using damascene processes, low selectivity between the conductive layer and the underlying barrier layer is required.

As device geometries scale, CMP of the multilevel interconnect structures with high productivity and low defects is desirable. Because a CMP process involves chemical reactions and mechanical actions, the speed of the chemical reactions is sensitive to temperature. Increasing polishing temperature will result in an increase in the chemical reaction speed and, hence, an increase in the polishing rate. The CMP rate normally increases with the polishing time due to the temperature increase caused by the friction between the abrasive particles and the substrate surface. However, because removal rates of different materials are affected differently by the temperature increase, methods for controlling the CMP process relying on friction do not allow the polishing rate or the selectivity of that rate across different layers to be optimized.

According to some embodiments of the present disclosure, an external heating system is provided in a CMP system. The external heating system is configured to heat one or more components such as polishing pad, substrate and slurry before and/or during a CMP through radiation. By increasing the temperature of the CMP process, the external heating system helps to enhance the overall CMP rate and, hence, increases production throughput. Introducing the external heating system also allows adjusting polishing temperature at different CMP stages to reduce polishing rate differences between different materials during the CMP process. The external heating system, thus, helps to improve polishing selectivity towards different materials. As a result, the defects, such as metal dishing, caused by different removal rates for different materials are reduced.

Figure 1B:
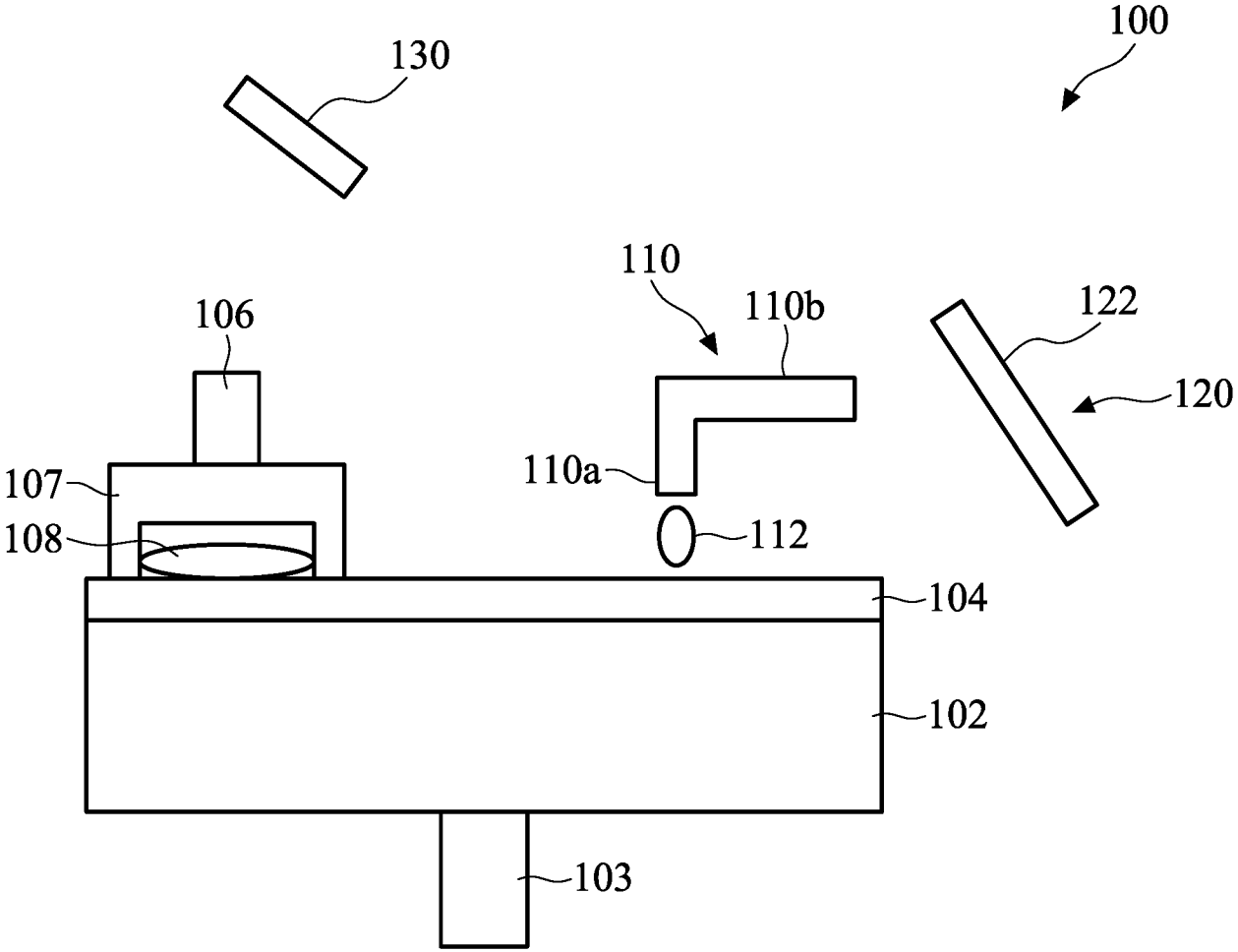
FIG. 1B is a cross-sectional view of the CMP system of FIG. 1A in accordance with some embodiments.
Figure 7:
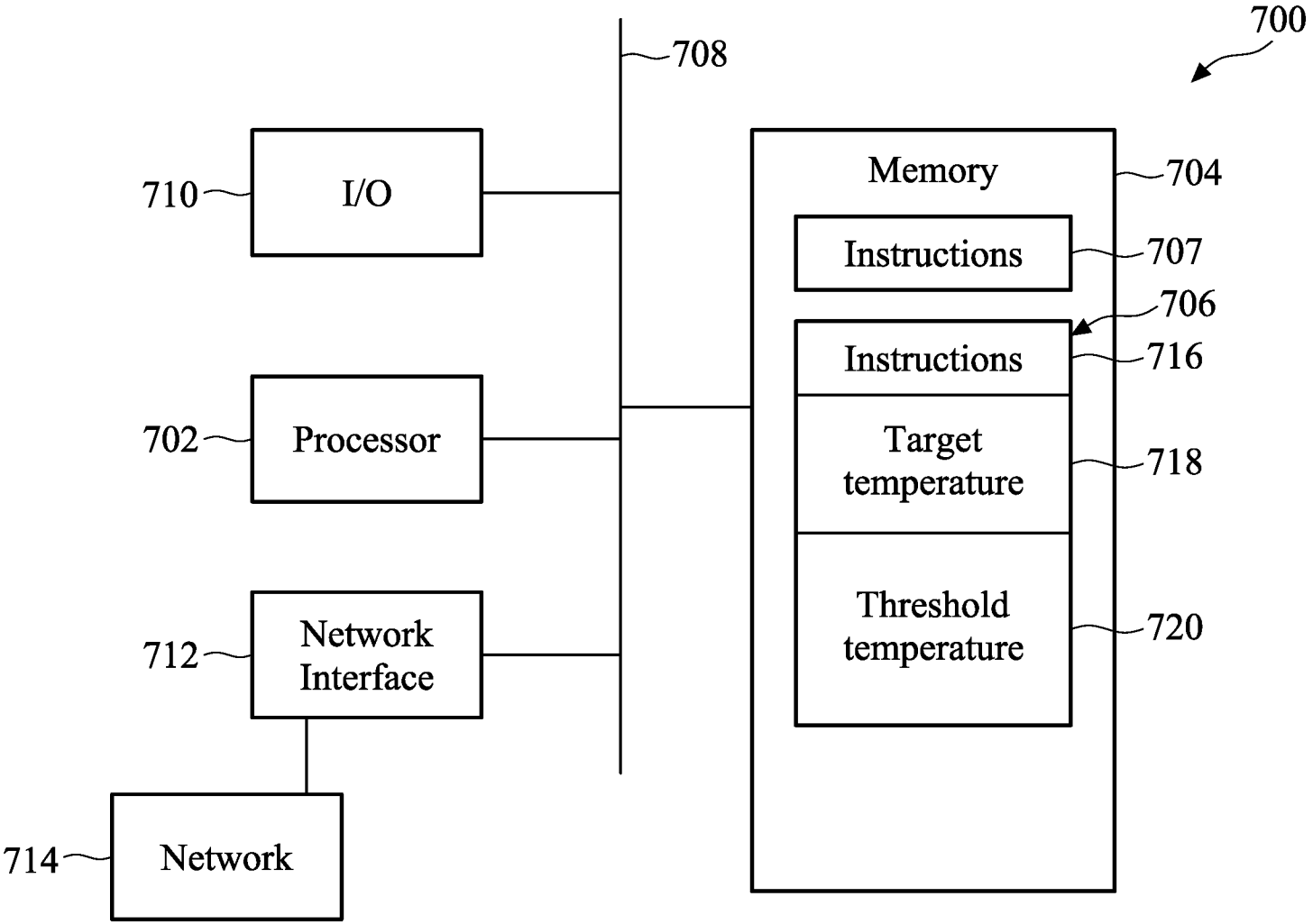
FIG. 7 is a diagram of a control system for controlling a CMP system in accordance with some embodiments.

FIG. 1A is a plan view of a CMP system 100, in accordance with some embodiments. FIG. 1B is a cross-sectional view of the CMP system 100 of FIG. 1A, in accordance with some embodiments. Referring to FIGS. 1A and 1B, the CMP system 100 includes a platen 102, a polishing pad 104 provided on top of the platen 102, a polishing head 106 configured to hold a substrate 108 proximate to the polishing pad 104, and a slurry delivery system 110 configured to deliver a slurry 112 to the polishing pad 104 to facilitate removal of materials such as metals for formation of interconnect structures from the substrate 108. The CMP system 100 further includes a heating system 120 configured to heat one or more components of the CMP system 100, such as polishing pad 104, substrate 108, and slurry 112, before and/or during the CMP process. A sensor 130 is configured to monitor the temperature of the polishing pad 104 before and/or during the CMP process. A controller 140 is configured to receive information from sensor 130 and to control the heating system 120 based on the received information. In some embodiments, the controller 140 is implemented using control system 700 (FIG. 7). In some embodiments, the CMP system 100 further includes a dressing disk (not shown) configured to restore a roughness of the polishing pad 104.

The CMP system 100 removes one or more materials from the substrate 108 based on relative motion between the polishing pad 104 and the polishing head 106. The slurry 112 that is introduced to the polishing pad 104 by the slurry delivery system 110 reacts with the one or more materials on the substrate 108, and mechanical force exerted on the substrate 108 by the polishing pad 104 removes the one or more materials from the substrate 108.

The platen 102 is configured to rotate in a first direction. In some embodiments, the platen 102 is configured to rotate in more than one direction. In some embodiments, the platen 102 is configured to have a constant rotational speed. In some embodiments, the platen 102 is configured to have a variable rotational speed. In some embodiments, the platen 102 is rotated by a motor through a platen spindle 103. In some embodiments, the motor is an alternating current (AC) motor, a direct current (DC) motor, a universal motor, or another suitable motor. In other embodiments, the platen 102 is configured to be held stationary. In some embodiments, the platen 102 is configured to translate in one or more directions.

The platen 102 is configured to support the polishing pad 104. The polishing pad 104 is configured to connect to the platen 102 so that the polishing pad 104 rotates in a same direction at a same speed as the platen 102. In some embodiments where the platen 102 is stationary, the polishing pad 104 is held stationary. In some embodiments, the polishing pad 104 has a textured surface which is configured to remove materials from the substrate 108 during operation of the CMP system 100.

The polishing head 106 is configured to support the substrate 108 during operation of the CMP system 100. In some embodiments, the polishing head 106 includes a retaining ring 107 to secure the substrate 108 against the polishing head 106. In some embodiments, the polishing head 106 includes a vacuum to secure the substrate 108 against the polishing head 106. The polishing head 106 is configured to rotate in a second direction. In some embodiments, the second direction is the same as the first direction. In some embodiments, the second direction is opposite the first direction. In some embodiments, the polishing head 106 is configured to rotate at a constant rotational speed. In some embodiments, the polishing head 106 is configured to rotate at a variable rotational speed. In some embodiments, the polishing head 106 is rotated by a motor. In some embodiments, the motor is an AC motor, a DC motor, a universal motor, or another suitable motor. In some embodiments, the polishing head 106 is held stationary. In some embodiments, the polishing head 106 is configured to translate across the surface of the polishing pad 104.

The polishing head 106 is configured to move in a direction perpendicular to the surface of the polishing pad 104. By moving the polishing head 106 in the direction perpendicular to the surface of the polishing pad 104, the pressure exerted on the substrate 108 by the polishing head 106 is adjustable. In some embodiments, the polishing head 106 includes pressure sensors to monitor a pressure exerted on the substrate 108. In some embodiments, the pressure sensors are connected to a control system. In some embodiments, the polishing head 106 includes pressure adjustment devices configured to exert force on a surface of substrate 108 opposite polishing pad 104 to adjust the pressure exerted on the substrate 108 at various locations of the substrate 108. In some embodiments, the pressure adjustment devices include nozzles configured to emit pressurized gas, translatable pins or other suitable force exerting elements.

The slurry delivery system 110 is configured to dispense the slurry 112 that contains abrasive particles such as silica or alumina particles suspended in either a basic or an acidic solution onto the polishing pad 104. The pressure and relative motion between the substrate 108 and the polishing pad 104, in conjunction with the slurry 112, result in polishing of the substrate 108. The slurry delivery system 110 includes an outlet 110*a* through which the slurry 112 from a slurry reservoir is dispensed onto the polishing pad 104. The slurry delivery system 110 further includes a delivery arm 110*b* configured to translate a location of the outlet 110*a* relative to the surface of polishing pad 104. In some embodiments, the slurry delivery system 110 includes a slurry mixing system configured to mix various fluid compositions prior to delivering the mixture to the polishing pad 104.

The heating system 120 is configured to heat one or more components, such as polishing pad 104, substrate 108 and slurry 112, before or during the CMP process, thereby providing temperature control over the CMP process. For example, in formation of the interconnect structures, the heating system 120 is operable to heat at least one of polishing pad 104, substrate 108 and slurry 112, thus when the conductive layer (e.g., copper layer) is being polished, the conductive layer is able to be polished within a first temperature range to achieve a higher removal rate, and after the conductive layer is removed from the barrier layer to expose the barrier layer, the conductive layer and the barrier layer are able to be polished within a second temperature range to achieve optimal polishing selectivity between the conductive layer and the barrier layer. As a result, the production throughput and the yield of the CMP process are improved. In some embodiments, the polishing temperature is controlled from about 20° C. to about 80° C. using the heating system 120.

The heating system 120 includes one or more heating elements 122 disposed by a distance from the polishing pad 104. The one or more heating elements 122 supply heat through radiation and do not physically contact any component in the CMP system 100, the heating system 120, thus, is a non-contact type heating system. In some embodiments, the distance between each heating element 122 and the polishing pad 104 is from about 10 mm to about 500 mm. If the distance is too small, it would be difficult to control the polishing temperature, in some instances. If the distance is too great, the heating efficiency of the heating system 120 is unnecessarily reduced, in some instances.

Figure 2:
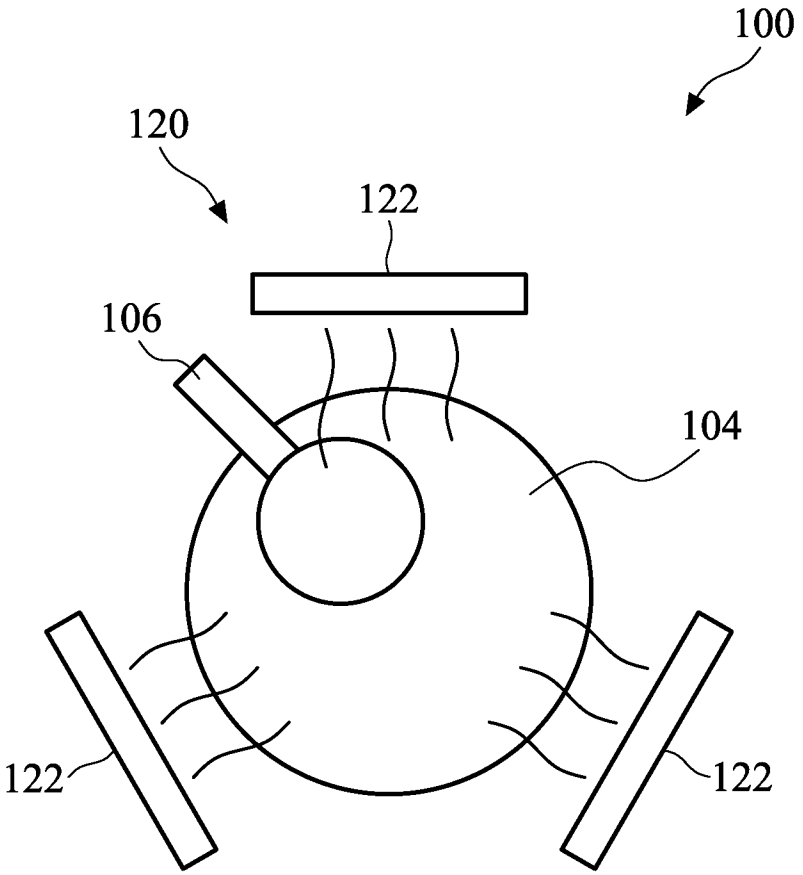
FIG. 2 is a plan view of a chemical mechanical polishing (CMP) system in accordance with some embodiments.

In some embodiments, and as in FIG. 1A, the heating system 120 includes a single heating element 122 disposed on a side of the polishing pad 104. Alternatively, in other embodiments, the single heating element 122 is disposed above the polishing pad 104. In some embodiments, the single heating element 122 is disposed above a center of the polishing pad 104. In some embodiments, and as in FIG. 2, the heating system 120 includes a plurality of heating elements 122 positioned along a perimeter of the polishing pad 104. This arrangement advantageously allows heating of entire polishing pad 104 by activating all heating elements 122 at once or alternatively heating only specifically localized region or regions of the polishing pad 104 by activating a subgroup of the heating elements 122. In some embodiments, multiple heating elements 122 are evenly spaced apart from each other, and are, thus, arranged in a uniform circular configuration around the perimeter of the polishing pad 104. Such configuration allows the polishing pad 104 to be evenly exposed to the radiant light and thereby heated uniformly. In some embodiments, multiple heating elements 122 are unevenly spaced apart from one another around the perimeter of the polishing pad 104. In some embodiments, multiple heating elements 122 include one or more upper heating elements positioned above the polishing pad 104 and one or more side heating elements positioned along the perimeter of the polishing pad 104. Each heating element 122, thus, has a corresponding illumination area associated with the polishing pad 104, the substrate 108, or the slurry 112 that is actively heated when each heating element 122 is activated and shines on the polishing pad 104, the substrate 108, and/or the slurry 112. Although three heating elements 122 are shown in FIG. 2, the heating system 120 may include any number of heating elements according to the polishing requirements.

Figure 3B:
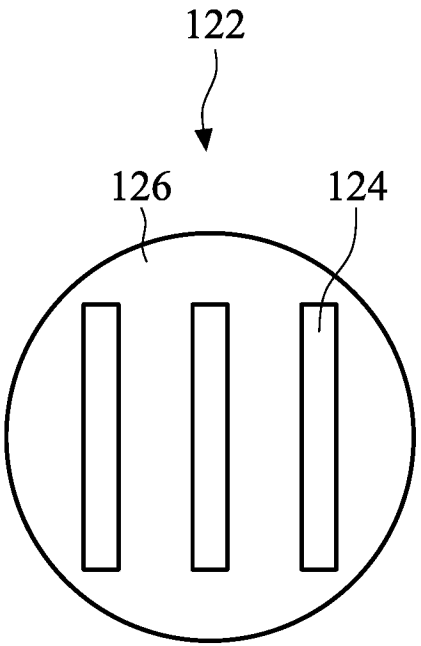
FIG. 3B is a plan view of a heating element in accordance with some embodiments.
Figure 3A:
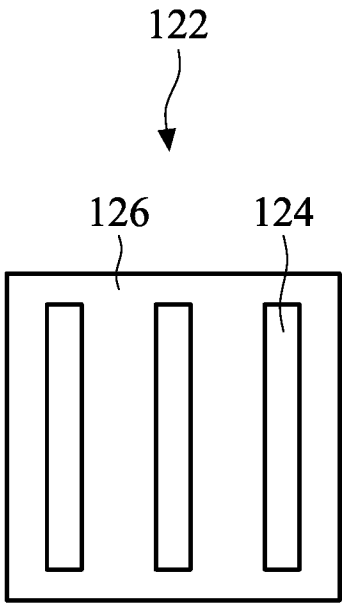
FIG. 3A is a plan view of a heating element in accordance with some embodiments.

FIGS. 3A and 3B are plan views of respective heating elements, in accordance with some embodiments. As in FIGS. 3A and 3B, each of the heating elements 122 includes one or more heating lamps 124 supported by a support plate 126. The heating lamps 124 may be any type of radiant heating lamps. Examples of heating lamps include, but are not limited to quartz lamps, ceramic lamps, halogen lamps, and xenon lamps. The heating lamps 124 may be arranged in any suitable pattern so long as the optimized polishing temperature is able to be reached during the CMP process. In some embodiments, and as in FIGS. 3A and 3B, the heating lamps 124 are arranged in parallel with respect to one another. The support plate 126 may take on any shape. In some embodiments, and as in FIG. 3A, the support plate 126 is square shaped. Alternatively, in other embodiments, and as in FIG. 3B, the support plate 126 is circular shaped. In yet other embodiments, the support plate 126 can be rectangular, elliptical, triangular, or trapezoidal shaped. Although three heating lamps 124 are shown in the heating element 122 (FIGS. 3A and 3B), each heating element 122 may include any number of heating lamps 124 according to the polishing requirements.

The sensor 130 is configured to measure the temperature of the polishing pad 104. In some embodiments, the sensor 130 is an infrared sensor configured to detect infrared radiation (e.g., infrared energy) from the polishing pad 104. A single sensor 130 is included in FIGS. 1A-2 for simplicity. In some embodiments, multiple sensors 130 are included to detect temperatures at different locations of the polishing pad 104. In some embodiments, the sensor 130 is an integrated array of sensing elements extending across a portion of the polishing pad 104. By collecting information on temperatures at different locations, sensors 130 would be able to more precisely measure the temperate of the polishing pad 104 when different locations of the polishing pad 104 are used for polishing.

The controller 140 is configured to receive information from the sensor 130. In some embodiments, the information includes the temperature of the polishing pad 104 before the CMP process starts. In some embodiments, the information includes the temperature of the polishing pad 104 after the CMP process starts. In some embodiments, the information includes the temperatures of the polishing pad 104 before and after the CMP process starts.

Based on the information from the sensor 130, the controller 140 is configured to control the heating system 120 to adjust the polishing temperature. In some embodiments, the controller 140 is configured to adjust the distance (either closer or further away) between the one or more heating elements 122 in the heating system 120 and the polishing pad 104 so as to control the polishing temperature based on the characteristics of the one or more materials being polished. In some embodiments, the controller 140 is configured to adjust the power (either increase or decrease) of the one or more heating elements 122 in the heating system 120 to control the polishing temperature based on the characteristics of the one or more materials being polished. In some embodiments, the controller 140 is configured to turn the one or more heating elements 122 in the heating system 120 off in instances where the polishing temperature is equal to a threshold temperature above which deterioration of the slurry or poor removal selectivity between different materials to be polished is about to occur and, thus, helps to reduce defect formation in integrated circuits.

During operation, at least one of the polishing pad 104, the substrate 108, and the slurry 112 is exposed to the radiant heat from the heating system 120. The sensor 130 monitors the heat radiated from the polishing pad 104 to obtain temperature information of the polishing pad 104. Based on the measured temperature, the controller 140 controls the polishing temperature to obtain an optimal material polishing rate or optimal polishing selectivity in response to the type of materials being polished.

Because the heating system 120 is capable of adjusting the temperature of the polishing pad 104, the CMP system 100 of the present disclosure can be employed to tailor the material polishing rate and/or polishing selectivity among layers of different materials. The CMP system 100, thus, helps to enhance production throughput and yield of integrated circuits.

Figure 4:
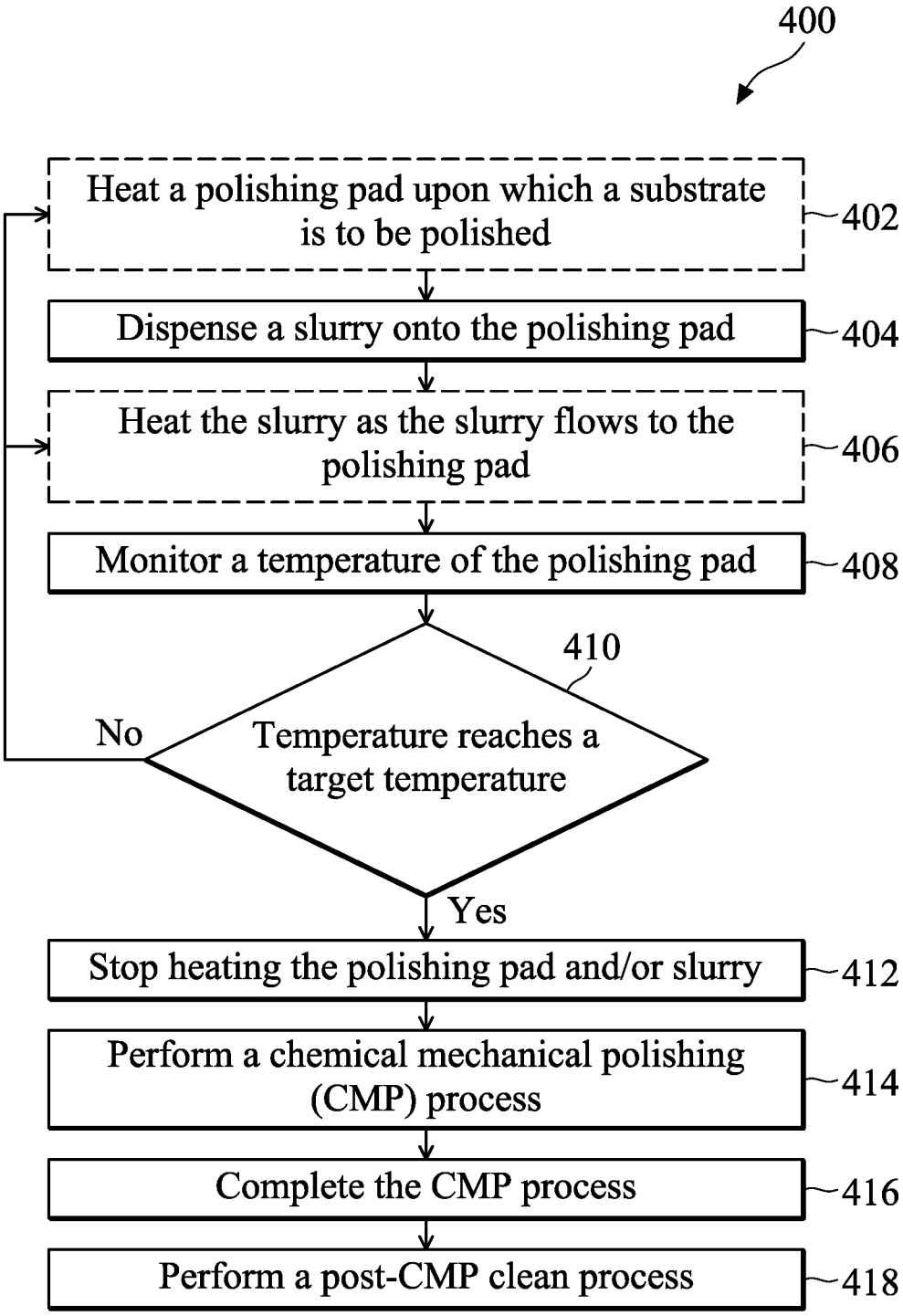
FIG. 4 is a flowchart of a method of controlling a temperature of a CMP process through ex-situ heating in accordance with some embodiments.

FIG. 4 is a flowchart of a method 400 of controlling temperature of a CMP process using a CMP system 100 through ex-situ heating, in accordance with some embodiments. In method 400, one or more components such as polishing pad 104 and slurry 112 are pre-heated before the CMP process starts and, thus, the polishing temperature is controlled ex-situ.

In operation 402, the polishing pad 104 is heated using the heating system 120. In some embodiments, the heating system 120 includes a single heating element 122 as in FIG. 1A. In other embodiments, the heating system 120 includes multiple heating elements 122 as in FIG. 2. In some embodiments, operation 402 is omitted.

In operation 404, a slurry 112 is dispensed onto the polishing pad 104 using a slurry delivery system 110.

In operation 406, the slurry 112 is heated as the slurry 112 continuously flows onto the polishing pad 104 using the heating system 120. As the slurry 112 being heated by the heating system 120 continuously flows onto the polishing pad 104, the slurry 112 heats the polishing pad 104. As a result, the temperature of the polishing pad 104 is also increased. In some embodiments, operation 406 is omitted.

In operation 408, the temperature of the polishing pad 104 is monitored. In some embodiments, the temperature of the polishing pad 104 is monitored using a single point of detection. In some embodiments, the temperature of the polishing pad 104 is monitored using multiple points of detection. In some embodiments, the temperature of the polishing pad 104 is monitored using the sensor 130.

In operation 410, the temperature of the polishing pad 104 is compared with a target temperature at which the material to be polished is able to be removed at an optimal removal rate or at which different materials to be polished are able to be removed with an optimal polishing selectivity. In some embodiments, the target temperature is determined based on empirical data related to characteristics of one or more materials being removed. In some embodiments, the polishing pad 104 is heated to a temperature between about 20° C. to about 80° C. In some embodiments, the polishing pad 104 is heated to about 30° C. or greater, such as about 40° C. The method 400 continues performing operation 402 and/or 406 in response to the temperate of the polishing pad 104 not having reached the target temperature. The method 400 proceeds to operation 412 in response to the temperature of the polishing pad 104 having reached the target temperature.

In operation 412, the heating system 120 is turned off, and no heat is supplied to the polishing pad 104 and/or the slurry 112. Heating of the polishing pad 104 and/or the slurry 112 thus stops.

In operation 414, a CMP process is begun. As the slurry 112 flows onto the polishing pad 104, the polishing head 106 applies force to the substrate 108 and the substrate 108 is rotated against the polishing pad 104 in the presence of the slurry 112. The mechanical force between the substrate 108 and the polishing pad 104 in conjunction with the chemical force asserted by the slurry 112 remove one or more overburden materials from the substrate 108. In some embodiments, the substrate 108 is rotated relative to the polishing pad 104. In some embodiments, the polishing pad 104 is rotated relative to the substrate 108. In some embodiments, both the substrate 108 and the polishing pad 104 are rotated.

In operation 416, the CMP process is continued until the one or more overburden materials are completely removed from the surface of the substrate.

In operation 418, a post-CMP clean process is performed. After the CMP process is completed, the polished surface of the substrate 108 is cleaned using a cleaning solution.

The method 400 allows for removing one or more overburden materials in a relatively short time span and with better polishing selectivity due to the optimized polishing temperature achieved by using the heating system 120.

Figure 5:
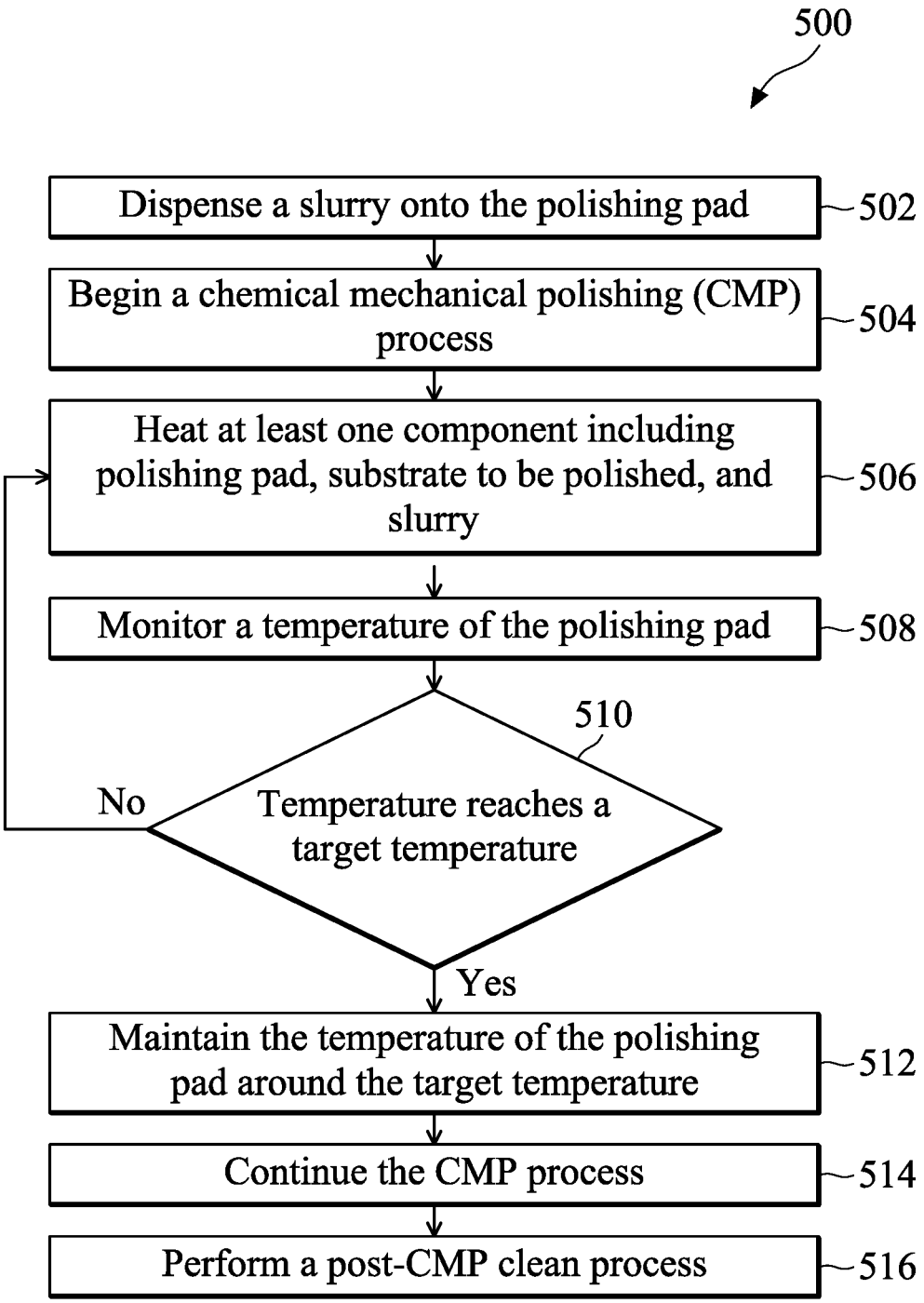
FIG. 5 is a flowchart of a method of controlling a temperature of a CMP process through in-situ heating in accordance with some embodiments.

FIG. 5 is a flowchart of a method 500 of controlling the temperature of a CMP process using a CMP system 100 through in-situ heating, in accordance with some embodiments. In method 500, one or more components such as polishing pad 104, substrate 108, and slurry 112 are heated during the CMP process and, thus, the polishing temperature is controlled in-situ.

In operation 502, the slurry 112 is dispensed onto the polishing pad 104 using the slurry delivery system 110.

In operation 504, a CMP process is begun. As the slurry 112 continuously flows onto the polishing pad 104, the polishing head 106 applies force to the substrate 108 and the substrate 108 is rotated against the polishing pad 104 in the presence of the slurry 112. The mechanical force between the substrate 108 and the polishing pad 104, in conjunction with the chemical force asserted by the slurry 112, remove one or more overburden materials from the substrate 108. In some embodiments, the substrate 108 is rotated relative to the polishing pad 104. In some embodiments, the polishing pad 104 is rotated relative to the substrate 108. In some embodiments, both the substrate 108 and the polishing pad 104 are rotated. In this way, the substrate 108 is polished to remove the one or more overburden materials in a relatively short timespan due to the increased polishing temperature.

In operation 506, during the CMP process, at least one component, such as polishing pad 104, substrate 108, or slurry 112, is heated using the heating system 120. In some embodiments, the heating system 120 includes a single heating element 122 as in FIG. 1A. In other embodiments, the heating system 120 includes multiple heating elements 122 as in FIG. 2. In some embodiments, at least one of polishing pad 104, substrate 108, or slurry 112 is heated to a temperature between about 20° C. to about 80° C. In some embodiments, at least one of polishing pad 104, substrate 108, or slurry 112 is heated to about 30° C. or greater, such as about 40° C. In some embodiments, only the polishing pad 104 is heated during the CMP process. In some embodiments, all three components, polishing pad 104, substrate 108 and slurry 112, are heated during the CMP process.

In operation 508, the temperature of the polishing pad 104 is monitored. In some embodiments, the temperature of the polishing pad 104 is monitored using a single point of detection. In some embodiments, the temperature of the polishing pad 104 is monitored using multiple points of detection. In some embodiments, the temperature of the polishing pad 104 is monitored using the sensor 130.

In operation 510, the temperature of the polishing pad 104 is compared with a target temperature at which the material to be polished is able to be removed at an optimal removal rate or at which different materials to be polished are able to be removed with an optimal polishing selectivity. In some embodiments, the target temperature is determined based on empirical data related to characteristics of the one or more materials being polished. In some embodiments, the polishing pad 104 is heated to a temperature between about 20° C. to about 80° C. In some embodiments, the polishing pad 104 is heated to about 30° C. or greater, such as about 40° C. The method 500 continues performing operation 506 in response to the temperate of the polishing pad 104 not having reached the target temperature. The method 500 proceeds to operation 512 in response to the temperature of the polishing pad 104 having reached the target temperature.

In operation 512, the temperature of the polishing pad 104 is maintained around the target temperature but below a threshold temperature. The threshold temperature is determined based on empirical data related to the temperature above which deterioration of the slurry or poor removal selectivity between different materials to be polished is about to occur. In some embodiments, the amount of heat supplied from the heating system 120 is controlled to keep the temperature of the polishing pad 104 around the target temperature but below the threshold temperature. In some embodiments, the amount of heat supplied from the heat system 120 is controlled, for example, by moving one or more heating elements 122 in the heating system 120 either closer to or further away from the polishing pad 104, or by tuning (e.g., either increasing or decreasing) the power of one or more heating elements 122 in the heating system 120. In some embodiments, the amount of heat supplied from the heating system 120 is controlled by turning one or more heating elements 122 in the heating system 120 off.

In operation 514, the CMP process is continued until the one or more overburden materials are completely removed from the surface of the substrate.

In operation 516, a post-CMP clean process is performed. After the CMP process is stopped, the polished surface of the substrate 108 is cleaned using a cleaning solution.

The method 500 allows for removing one or more overburden materials in a relatively short time span and with better polishing selectivity due to the optimized polishing temperature achieved by using the heating system 120.

Figure 6:
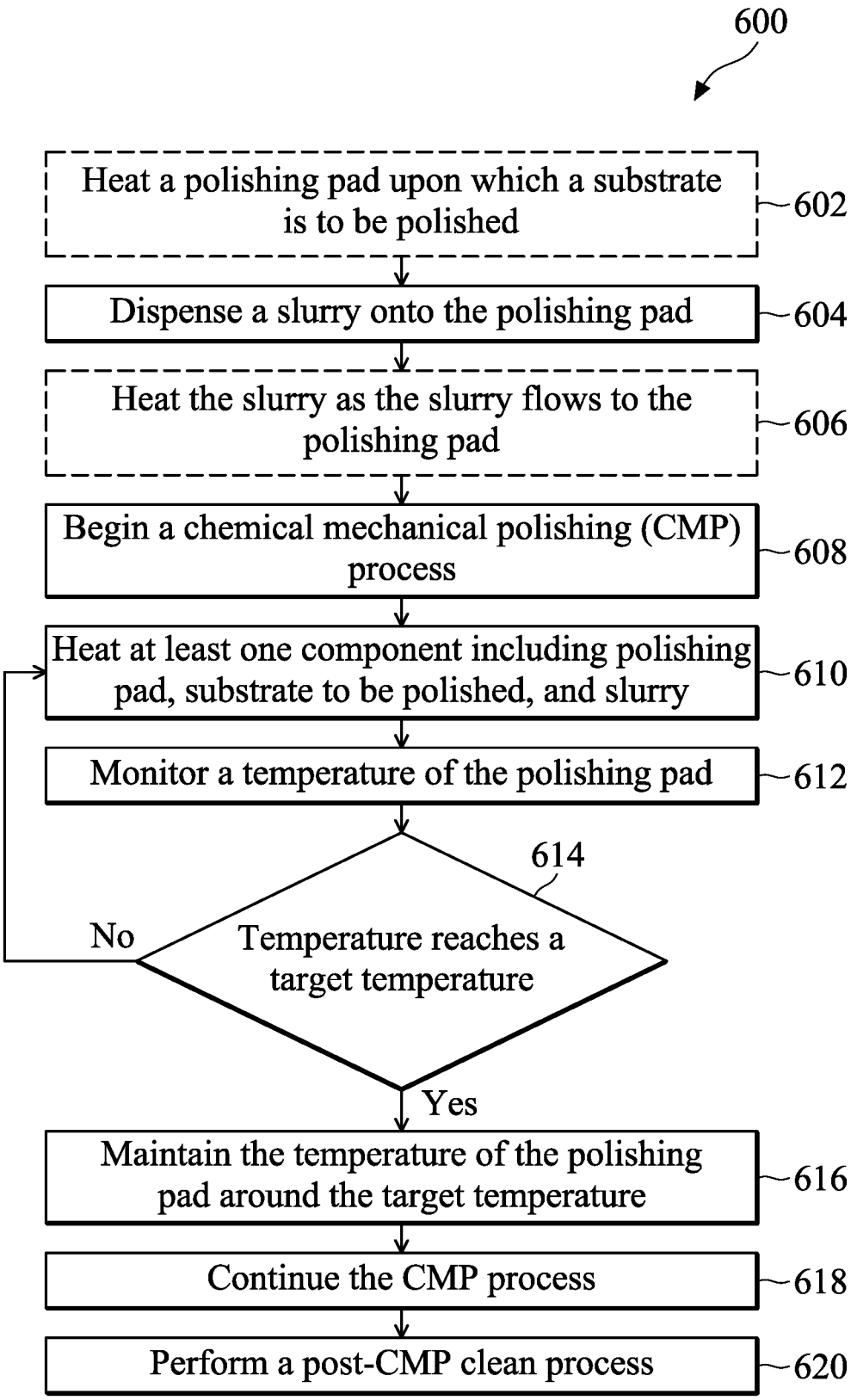
FIG. 6 is a flowchart of a method of controlling a temperature of a CMP process through both ex-situ heating and in-situ heating in accordance with some embodiments

FIG. 6 is a flowchart of a method 600 of controlling temperature for a CMP process using a CMP system 100 through both in-situ heating and ex-situ heating, in accordance with some embodiments.

In operation 602, the polishing pad 104 is heated using the heating system 120. In some embodiments, the heating system 120 includes a single heating element 122 as in FIG. 1A. In other embodiments, the heating system 120 includes multiple heating element 122 as in FIG. 2. In some embodiments, operation 602 is omitted.

In operation 604, the slurry 112 is dispensed onto the polishing pad 104 using a slurry delivery system 110.

In operation 606, the slurry 112 is heated as the slurry 112 continuously flows onto the polishing pad 104 using the heating system 120. As the slurry 112 being heated by the heating system 120 continuously flows onto the polishing pad 104, the slurry 112 heats the polishing pad 104. As a result, the temperature of the polishing pad 104 is also increased. In some embodiments, operation 606 is omitted.

In operation 608, a CMP process is begun. As the slurry 112 continuously flows onto the polishing pad 104, the polishing head 106 applies force to the substrate 108 and the substrate 108 is rotated against the polishing pad 104 in the presence of the slurry 112. The mechanical force between the substrate 108 and the polishing pad 104, in conjunction with the chemical force asserted by the slurry 112, removes the one or more overburden materials from the substrate 108. In some embodiments, the substrate 108 is rotated relative to the polishing pad 104. In some embodiments, the polishing pad 104 is rotated relative to the substrate 108. In some embodiments, both the substrate 108 and the polishing pad 104 are rotated. In this way, the substrate 108 is polished to remove the one or more overburden materials in a relatively short timespan due to the increased polishing temperature.

In operation 610, during the CMP process, at least one component, such as polishing pad 104, substrate 108, or slurry 112, is heated using the heating system 120. In some embodiments, at least one of polishing pad 104, substrate 108, and slurry 112 is heated to a temperature between about 20° C. to about 80° C. In some embodiments, at least one of polishing pad 104, substrate 108, and slurry 112 is heated to about 30° C. or greater, such as about 40° C. In some embodiments, only the polishing pad 104 is heated during the CMP process. In some embodiments, all three components, i.e., polishing pad 104, substrate 108 and slurry 112, are heated during the CMP process.

In operation 612, the temperature of the polishing pad 104 is monitored. In some embodiments, the temperature of the polishing pad 104 is monitored using a single point of detection. In some embodiments, the temperature of the polishing pad 104 is monitored using multiple points of detection. In some embodiments, the temperature of the polishing pad 104 is monitored using the sensor 130.

In operation 614, the temperature of the polishing pad 104 is compared with a target temperature at which the material to be polished is able to be removed at an optimal removal rate or at which different materials to be polished are able to be removed with an optimal removal selectivity. In some embodiments, the target temperature is determined based on characteristics of one or more materials being polishing. In some embodiments, the polishing pad 104 is heated to a temperature between about 20° C. to about 80° C. In some embodiments, the polishing pad 104 is heated to about 30° C. or greater, such as about 40° C. The method 600 continues performing operation 610 in response to the temperate of the polishing pad 104 not having reached the target temperature. The method 600 proceeds to operation 616 in response to the temperature of the polishing pad 104 having reached the target temperature.

In operation 616, the temperature of the polishing pad 104 is maintained around the target temperature but below a threshold temperature. The threshold temperature is determined based on empirical data related to the temperature above which deterioration of the slurry or poor removal selectivity between different materials to be polished is about to occur. In some embodiments, the amount of heat supplied from the heating system 120 is controlled to keep the temperature of the polishing pad 104 around the target temperature but below the threshold temperature. In some embodiments, the amount of heat supplied from the heat system 120 is controlled, for example, by moving one or more heating elements 122 in the heating system 120 further away from the polishing pad 104, or by adjusting e.g., either increasing or decreasing the power of one or more heating elements 122 in the heating system 120. In some embodiments, the amount of heat supplied from the heating system 120 is controlled by turning one or more heating elements 122 in the heating system 120 off.

In operation 618, the CMP process is continued until the one or more overburden materials are completely removed from the surface of the substrate.

In operation 620, a post-CMP clean process is performed. After the CMP process is completed, the polished surface of the substrate 108 is cleaned using a cleaning solution.

The method 600 allows for removing one or more overburden materials in a relatively short time span and with better removal selectivity due to the optimized polishing temperature achieved by using the heating system 120.

FIG. 7 is a block diagram of a control system 700 for controlling a CMP system 100 in accordance with some embodiments. Control system 700 includes a hardware processor 702 and a non-transitory, computer readable storage medium 704 encoded with, i.e., storing, computer program code 706, i.e., a set of executable instructions. Computer readable storage medium 704 is also encoded with instructions 707 for interfacing with components of CMP system 100. The processor 702 is electrically coupled to the computer readable storage medium 704 via a bus 708. The processor 702 is also electrically coupled to an I/O interface 710 by bus 708. A network interface 712 is also electrically connected to the processor 702 via bus 708. Network interface 712 is connected to a network 714, so that processor 702 and computer readable storage medium 704 are capable of connecting to external elements via network 714. The processor 702 is configured to execute the computer program code 706 encoded in the computer readable storage medium 704 in order to cause control system 700 to be usable for performing a portion or all of the operations as described with respect to CMP system 100.

In some embodiments, the processor 702 is a central processing unit (CPU), a multi-processor, a distributed processing system, an application specific integrated circuit (ASIC), and/or a suitable processing unit.

In some embodiments, the computer readable storage medium 704 is an electronic, magnetic, optical, electromagnetic, infrared, and/or a semiconductor system (or apparatus or device). For example, the computer readable storage medium 704 includes a semiconductor or solid-state memory, a magnetic tape, a removable computer diskette, a random access memory (RAM), a read-only memory (ROM), a rigid magnetic disk, and/or an optical disk. In some embodiments using optical disks, the computer readable storage medium 704 includes a compact disk-read only memory (CD-ROM), a compact disk-read/write (CD-R/W), and/or a digital video disc (DVD).

In some embodiments, the storage medium 704 stores the computer program code 706 configured to cause control system 700 to perform the operations as described with respect to CMP system 100. In some embodiments, the storage medium 704 also stores information needed for performing the operations as described with respect to CMP system 100, such as a sensor parameter 716, a target temperature parameter 718, a threshold temperature parameter 720 and/or a set of executable instructions to perform the operation as described with respect to CMP system 100.

In some embodiments, the storage medium 704 stores instructions 707 for interfacing with CMP system 100. The instructions 707 enable processor 702 to generate operating instructions readable by elements of the CMP system 100 to effectively implement the operations as described with respect to CMP system 100.

Control system 700 includes I/O interface 710. I/O interface 710 is coupled to external circuitry. In some embodiments, I/O interface 710 includes a keyboard, keypad, mouse, trackball, trackpad, and/or cursor direction keys for communicating information and commands to processor 702.

Control system 700 also includes network interface 712 coupled to the processor 702. Network interface 712 allows control system 700 to communicate with network 714, to which one or more other computer systems are connected. Network interface 712 includes wireless network interfaces such as BLUETOOTH, WIFI, WIMAX, GPRS, or WCDMA; or wired network interface such as ETHERNET, USB, or IEEE-1394. In some embodiments, the operations as described with respect to CMP system 100 are implemented in two or more control systems 700, and information such as sensor information, conditioning iterations information, conditioner pressure and target roughness are exchanged between different control systems 700 via network 714.

Control system 700 is configured to receive information related to the sensor, e.g., sensor 130 (FIGS. 1A-2), through I/O interface 710. The information is transferred to processor 702 via bus 708 and then stored in computer readable medium 704 as sensor parameter 716. Control system 700 is configured to receive information related to the target temperature and threshold temperature through I/O interface 710. In some embodiments, the target and threshold temperature information is received from an operator. The information is stored in computer readable medium 704 as target temperature parameter 718 and threshold temperature parameter 720.

During operation, in some embodiments, processor 702 executes a set of instructions to determine whether the temperature of the polishing pad 104 has reached a target temperature. During operation, processor 702 executes a set of instructions to determine whether the temperature of the polishing pad 104 has reached a threshold temperature. Based on the above determinations, processor 702 generates a control signal to instruct the heating system 120 to continuously supply heat to one or more polishing components including the polishing pad 104, the substrate 108 and the slurry 112, or to stop the heating. In some embodiments, the control signal is transmitted using I/O interface 710. In some embodiments, the control signal is transmitted using network interface 712.

Figure 8:
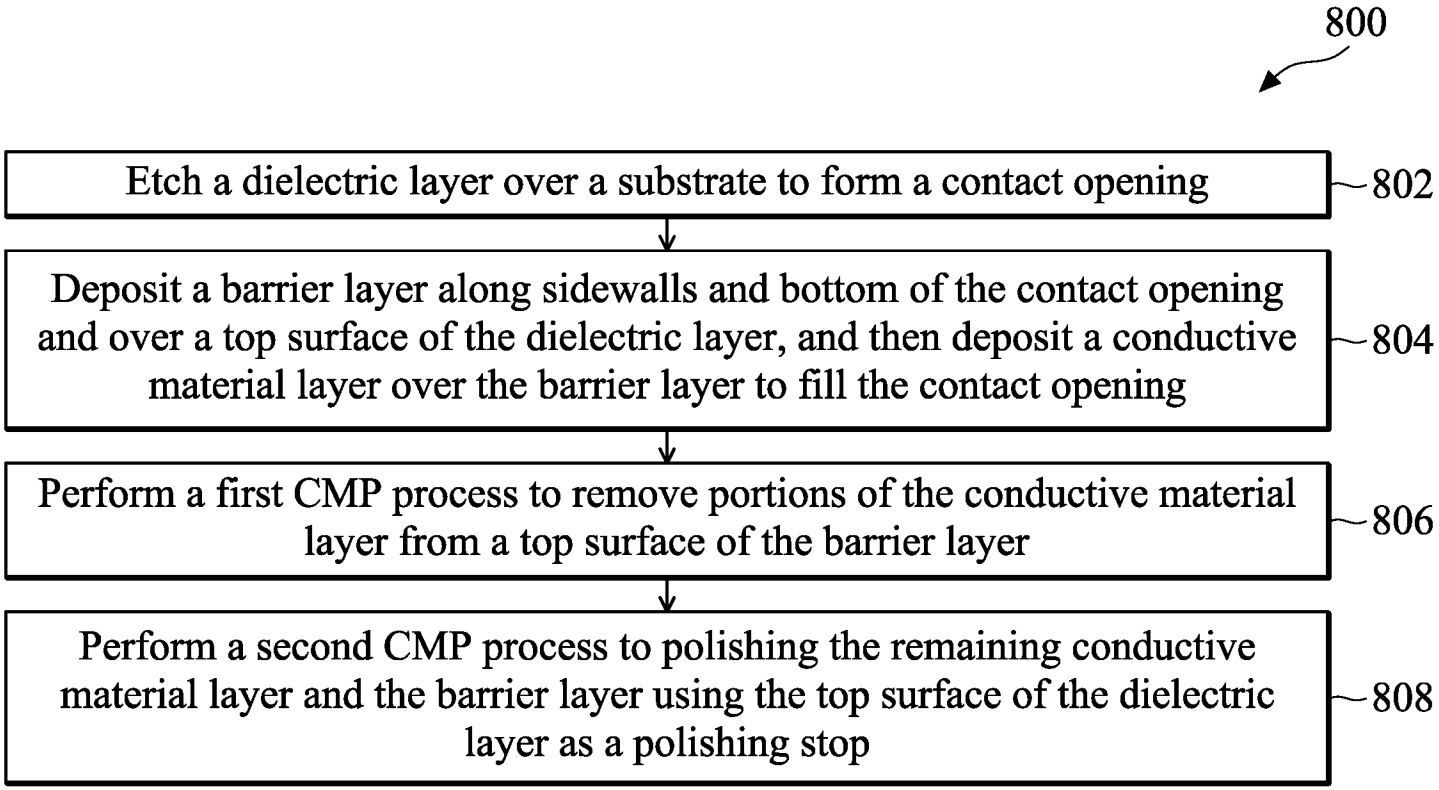
FIG. 8 is a flowchart of a method of fabricating a semiconductor structure, in accordance with some embodiments.

FIG. 8 is a flowchart of a method 800 of fabricating a semiconductor structure 900, in accordance with some embodiments. FIGS. 9A-9D are cross-sectional views of the semiconductor structure 900 at various fabrication stages of the method 800, in accordance with some embodiments. The method 800 is discussed in detail below, with reference to the semiconductor structure, in FIGS. 9A-9D. In some embodiments, additional operations are performed before, during, and/or after the method 800, or some of the operations described are replaced and/or eliminated. In some embodiments, additional features are added to the semiconductor structure 900. In some embodiments, some of the features described below are replaced or eliminated. One of ordinary skill in the art would understand that although some embodiments are discussed with operations performed in a particular order, these operations may be performed in another logical order.

Figure 9A:
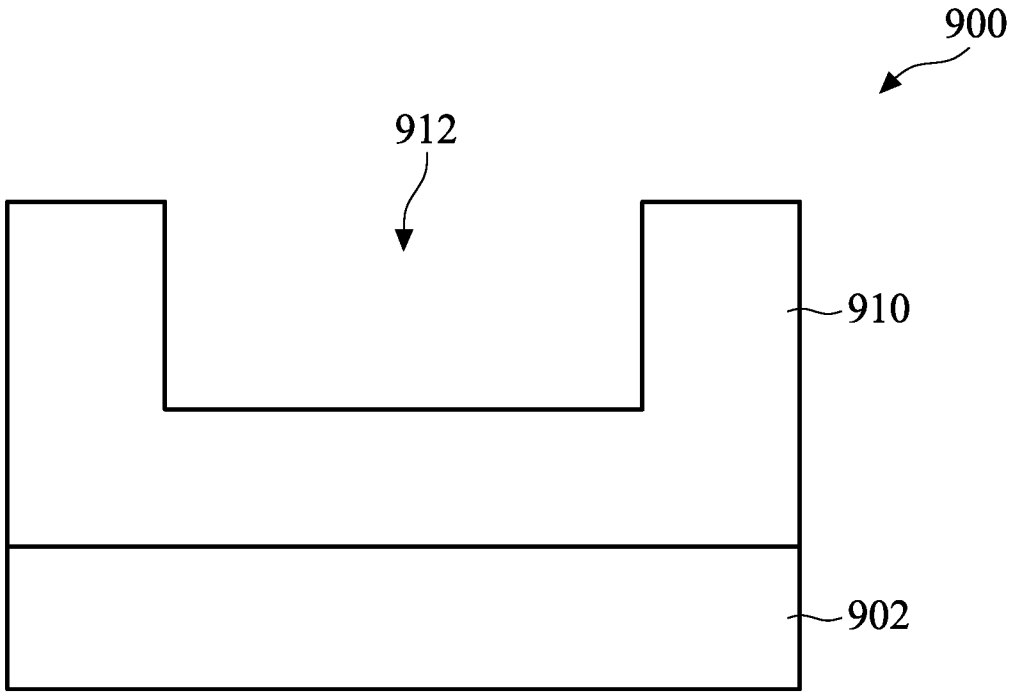
FIGS. 9A-9D are cross-sectional views of a semiconductor structure at various fabrication stages, in accordance with some embodiments.

Referring to FIGS. 8 and 9A, the method 800 includes operation 802, in which a dielectric layer 910 over a substrate 902 is etched to form a contact opening 912. FIG. 9A is a cross-sectional view of a semiconductor structure 900 after etching the dielectric layer 910 to form the contact opening 912.

In some embodiments, the substrate 902 is a bulk semiconductor substrate including silicon. Alternatively or additionally, in some embodiments the bulk semiconductor substrate includes another elementary semiconductor such as germanium, a compound semiconductor including gallium arsenide, gallium, phosphide, indium phosphide, indium arsenide, and/or indium antimonide, an alloy semiconductor including SiGe, GaAsP, AlinAs, AlGaAs, GalnAs, GaInP, and/or GaInAsP; or combinations thereof. In some embodiments, the substrate 902 includes an epitaxial layer. For example, the substrate 902 has an epitaxial layer overlying a bulk semiconductor substrate. Furthermore, in some embodiments, the substrate 902 is a semiconductor on insulator (SOI) substrate. For example, the substrate 902 includes a buried oxide (BOX) layer formed by a process such as separation by implanted oxygen (SIMOX) or other suitable techniques, such as wafer bonding and grinding.

In some embodiments, the substrate 902 further includes active devices such as p-type field effect transistors (PFET), n-type FET (NFET), metal-oxide semiconductor (MOS) transistors, complementary metal-oxide semiconductor (CMOS) transistors, bipolar transistors, high voltage transistors, and/or high frequency transistors. In some embodiments, the transistors are planar transistors or three-dimensional fin-type transistors. In some embodiments, the substrate 902 further includes passive devices such as resistors, capacitors, and/or inductors. The substrate 902 further includes isolation structures such as shallow trench isolation (STI) structures to separate various active and/or passive devices from one another.

The dielectric layer 910 is deposited over the substrate 902. In some embodiments and as in FIG. 9A, the dielectric layer 910 is deposited directly above and in contact with the substrate 902. In some embodiments, one or more dielectric layers containing contact structures therein are disposed between the dielectric layer 910 and the substrate 902.

In some embodiments, the dielectric layer 910 includes silicon oxide. In some embodiments, the dielectric layer 910 includes a low-k dielectric material having a dielectric constant (k) less than 4. In some embodiments, the low-k dielectric material has a dielectric constant from about 1.2 to about 3.5. In some embodiments, the dielectric layer 910 includes tetraethylorthosilicate (TEOS) oxide, undoped silicate glass, or doped silicate glass such as borophosphosilicate glass (BPSG), fluorosilica glass (FSG), phosphosilicate glass (PSG), boron doped silicon glass (BSG), and/or other suitable dielectric materials. In some embodiments, the dielectric layer 910 is deposited by chemical vapor deposition (CVD), plasma enhanced chemical vapor deposition (PECVD), physical vapor deposition (PVD), or spin coating. In some embodiments, the dielectric layer 910 is planarized by a planarization process or otherwise recessed to provide a planar top surface. In some embodiments, the top surface of the dielectric layer 910 is planarized using a CMP process.

The dielectric layer 910 is subsequently etched to form a contact opening 912 therein. The contact opening 912 is a trench opening, a via opening, or a combination of a trench opening and a via opening with the via opening enclosed by the trench opening. In some embodiments and as in FIG. 9A, the contact opening 912 is a trench opening. Although only a single contact opening is illustrated and described in FIG. 9A, it is understood that any number of contact openings can be formed.

The dielectric layer 910 is etched with one or more lithography and etching processes. In some embodiments, the lithography process includes applying a photoresist layer (not shown) over the dielectric layer 910, exposing the photoresist layer to a pattern, performing post-exposure baking, and developing the resist to form a patterned photoresist layer (not shown). The patterned photoresist layer exposes a portion of the dielectric layer 910 where the contact opening 912 is to be formed. Next, the portion of the dielectric layer 910 exposed by the patterned photoresist layer is etched to form the contact opening 912. In some embodiments, the dielectric layer 910 is etched using a dry etch such as, for example, a reactive ion etch (RIE) or a plasma etch. In some embodiments, the dielectric layer 910 is etching using a wet etch. After formation of the contact opening 912 in the dielectric layer 910, the patterned photoresist layer is removed, for example, by wet stripping or plasma ashing. Alternatively, in some embodiments, a hard mask is used such that the contact opening pattern is transferred from the pattered photoresist layer to the hard mask by a first etch and then transferred to the dielectric layer 910 by a second etch.

Figure 9B:
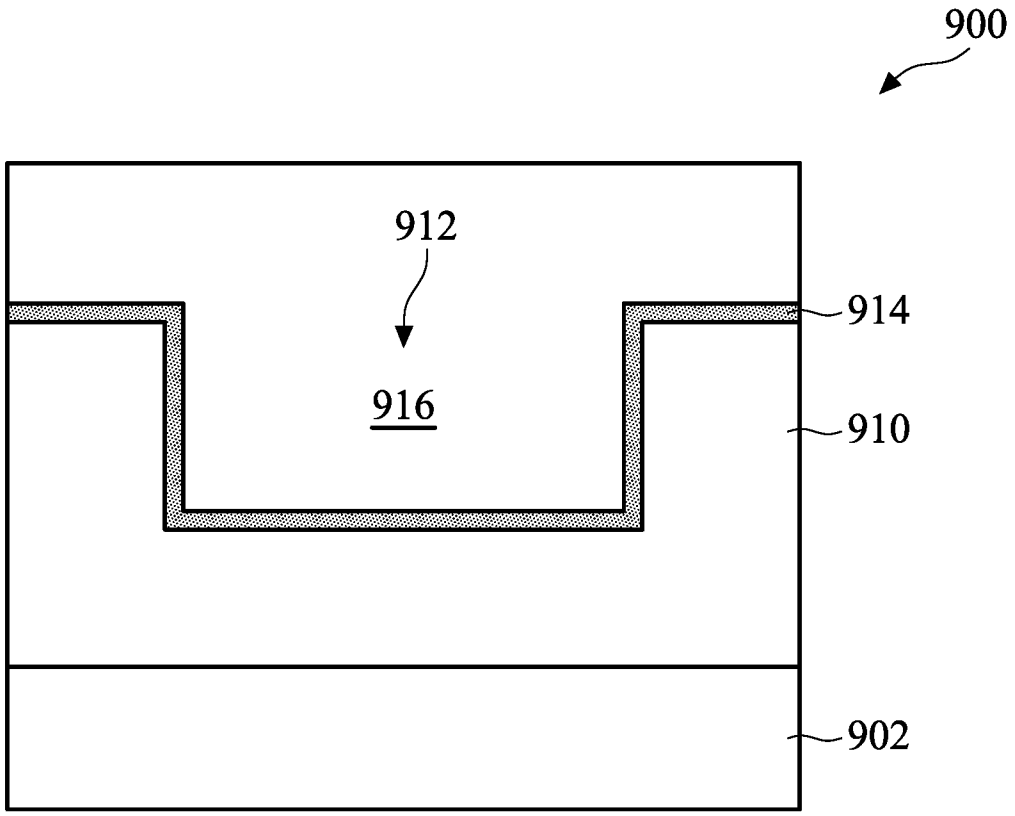

Referring to FIGS. 8 and 9B, the method 800 proceeds to operation 804, in which a barrier layer 914 is deposited along sidewalls and bottom of the contact opening 912 and over the top surface of the dielectric layer 910, followed by depositing a conductive material layer 916 over the barrier layer 914 to fill the contact opening 912. FIG. 9B is a cross-sectional view of the semiconductor structure 900 of FIG. 9A after depositing the barrier layer 914 along sidewalls and bottom of the contact opening 912 and over the top surface of the dielectric layer 910, and then depositing the conductive material layer 916 over the barrier layer 914 to fill the contact opening 912.

The barrier layer 914 includes a diffusion barrier material that prevents the metal in the conductive material layer 916 from diffusing into the dielectric layer 910. In some embodiments, the barrier layer 914 includes Ti, Ta, Ru, TiN, TaN, WN, or other suitable diffusion barrier materials. In some embodiments, the barrier layer 914 includes a stack of the above-mentioned diffusion barrier materials such as, for example, Ti/TiN or Ta/TaN. In some embodiments, the barrier layer 914 is deposited utilizing a conformal deposition process such as CVD, PECVD, PVD, or atomic layer deposition (ALD).

In some embodiments, the conductive material layer 916 includes Cu, Al, W, Co, alloys thereof, or other suitable conductive metals. In some embodiments, the conductive material layer 916 is deposited by a suitable deposition process such as, for example, CVD, PECVD, sputtering, or plating. In some embodiments, especially when Cu or a Cu alloy is employed in the conductive material layer 916, an optional plating seed layer (not shown) is formed over the barrier layer 914 prior to the formation of the conductive material layer 916. In some embodiments, the optional plating seed layer is formed by a deposition process including, for example, CVD, PECVD, ALD, and PVD.

Figure 9C:
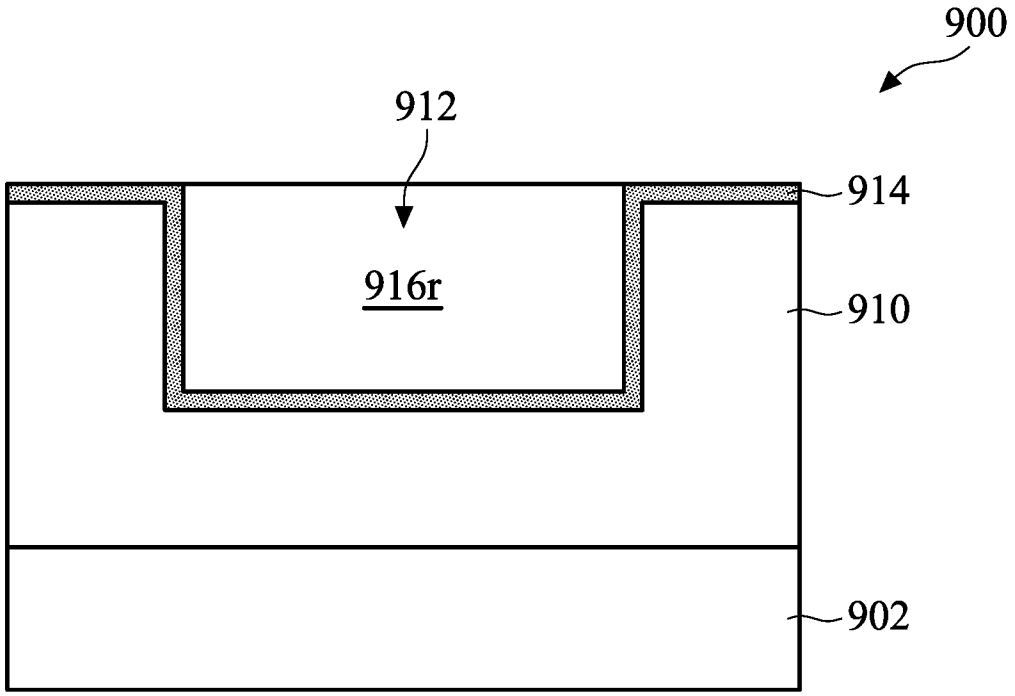

Referring to FIGS. 8 and 9C, the method 800 proceeds to operation 806, in which a first CMP process is performed to remove portions of the conductive material layer 916 from a top surface of the barrier layer 914. FIG. 9C is a cross-sectional view of the semiconductor structure 900 of FIG. 9B after removing portions of the conductive material layer 916 from the top surface of barrier layer 914.

The first CMP process polishes the material that provides the conductive material layer 916. The first CMP process is continued until the top surface of the barrier layer 914 that is above the top surface of the dielectric layer 910 outside of the contact opening 912 is exposed. The first CMP process is performed at a first temperature using the CMP system 100 at which the material that provides the conductive material layer 916 is removed at an optimized removal rate. The first temperature may be controlled using in-situ and/or ex-situ heating as described above in method 400 (FIG. 4), 500 (FIG. 5), or 600 (FIG. 6).

After the first CMP process, a remaining portion of the conductive material layer 916 (herein referred to as remaining conductive material layer 916*r*) has a top surface that is coplanar with the top surface of the barrier layer 914.

Figure 9D:
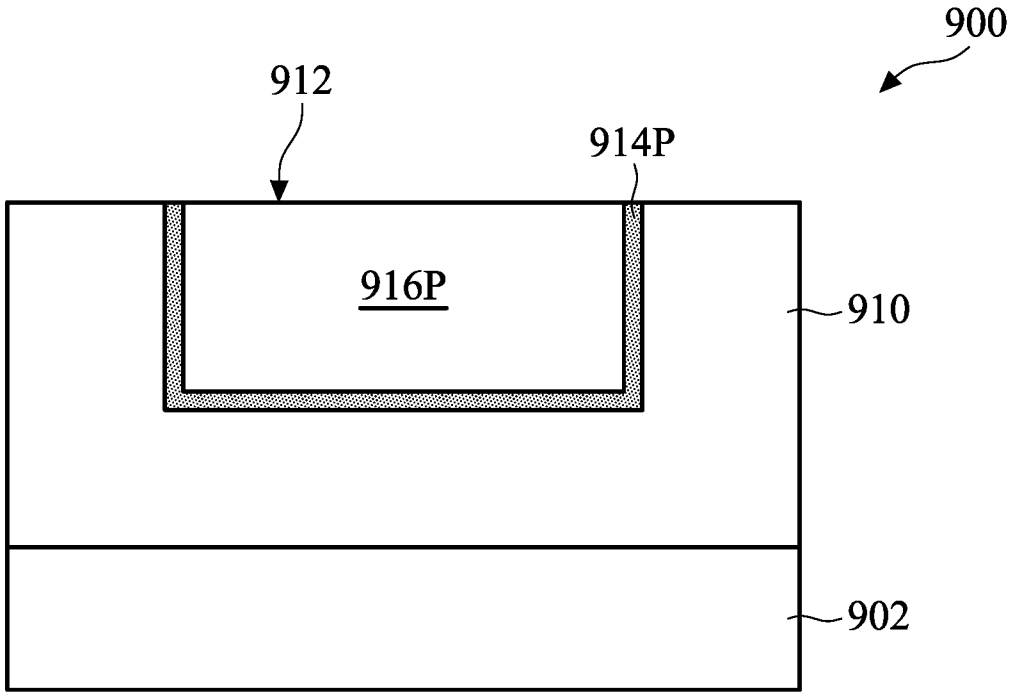

Referring to FIGS. 8 and 9D, the method 800 proceeds to operation 808, in which a second CMP process is performed to polish the remaining conductive material layer 916*r* and the barrier layer 914 using the top surface of the dielectric layer 910 as a polishing stop. FIG. 9D is a cross-sectional view of the semiconductor structure 900 of FIG. 9C after polishing the remaining conductive material layer 916*r* and the barrier layer 914 using the top surface of the dielectric layer 910 as a polishing stop.

The second CMP process polishes the material that provides the conductive material layer 916 and the material that provides the barrier layer 914 simultaneously. The second CMP process is continued until the top surface of the dielectric layer 910 is exposed. The second CMP process is performed at a second temperature using the CMP system 100 at which the material that provides the conductive material layer 916 and the material that provides the barrier layer 914 are removed simultaneously at an optimized removal rate. The second temperature is selected to reduce the polishing rate difference during the CMP process when two different materials are polished simultaneously, while at the same time maintaining the high production throughput. In some embodiments, the second temperature is greater than the first temperature. In some embodiments, the second temperature is less than the first temperature. The second temperature may be controlled using in-situ and/or ex-situ heating as described above in method 400 (FIG. 4), 500 (FIG. 5), or 600 (FIG. 6).

After the second CMP process, a remaining portion of the barrier layer 914 on the sidewalls and the bottom of the contact opening 912 constitutes a barrier portion 914P, and a remaining portion of the remaining conductive material layer 916*r* within the contact opening 912 constitutes a conductive portion 916P. The top surfaces of the barrier portion 914P and the conductive portion 916P are coplanar with the top surface of the dielectric layer 910. The barrier portion 914P and the conductive portion 916P that is surrounded by the barrier portion 914P together define a interconnect structure (914P, 916P).

After the second CMP process, a remaining portion of the barrier layer 914 on the sidewalls and the bottom of the contact opening 912 constitutes a barrier portion 214P, and a remaining portion of the remaining conductive material layer 916*r* within the contact opening 912 constitutes a conductive portion 916P. The top surfaces of the barrier portion 914P and the conductive portion 916P are coplanar with the top surface of the dielectric layer 910. The barrier portion 914P and the conductive portion 916P that is surrounded by the barrier portion 914P together define a interconnect structure (914P, 916P).

Although metal CMP using the CMP system 100 is illustrated and described, using the CMP system 100 of the present disclosure in other CMP processes, for example, dielectric CMP and poly CMP, is contemplated.

One aspect of this description relates to a chemical mechanical polishing (CMP) system. The CMP system includes a polishing pad configured to polish a substrate. The CMP system further includes a heating system configured to adjust a temperature of the polishing pad. The heating system includes at least one heating element spaced apart from the polishing pad. The CMP system further includes a sensor configured to measure the temperature of the polishing pad. In some embodiments, the heating system is free from physical contact with the polishing pad. In some embodiments, the heating system includes a single heating element at a side of the polishing pad. In some embodiments, the heating system includes a single heating element above the polishing pad. In some embodiments, the heating system includes a plurality of heating elements around a perimeter of the polishing pad. In some embodiments, the plurality of heating elements is evenly spaced apart from each other around the perimeter of the polishing pad. In some embodiments, at least one of the plurality of heating elements includes a plurality of heating lamps over a support plate. In some embodiments, the support plate is square shaped or circular shaped. In some embodiments, the heating system includes at least one ceramic lamp or at least one quartz lamp.

Another aspect of this description relates to a chemical mechanical polishing (CMP) system. The CMP system includes a polishing head configured to hold a substrate during a CMP process. The CMP system further includes a polishing pad configured to polish the substrate. The CMP system further includes a slurry delivery system configured to supply a slurry to the polishing pad. The CMP system further includes a heating system configured to heat at least one of the polishing pad and the slurry. The heating system is spaced form the polishing pad by a distance. The CMP system further includes a sensor configured to measure a temperature of the polishing pad. The CMP system further includes a controller configured to control the heating system based on information received from the sensor. In some embodiments, the heating system is configured to heat the at least one of the polishing pad and the slurry through infrared radiation. In some embodiments, the distance between the polishing pad and the heating system is from about 10 mm to about 500 mm. In some embodiments, the heating system includes at least one heating element. The at least one heating element is free from physical contact with the polishing head and the polishing pad. In some embodiments, the controller is configured to control a location of the at least one heating element.

Yet another aspect of this description relates to a method of controlling a temperature of a chemical mechanical polishing (CMP) process. The method includes dispensing a slurry onto a polishing pad. The method further includes polishing a surface of a substrate with the slurry. The method further includes heating the polishing pad as the surface of the substrate is being polished. The polishing pad is being heated through radiant heating using a heating system that is spaced apart from the polishing pad by a distance. The method further includes monitoring a temperature of the polishing pad. The method further includes maintaining the temperature of the polishing pad around a target temperature associated with one or more materials being polished. In some embodiments, the method further includes heating the slurry using the heating system as the slurry is being dispensed to the polishing pad and the surface of the substrate with the slurry is being polished with the slurry. In some embodiments, the method further includes heating the substrate using the heating system as the surface of the substrate is being polished. In some embodiments, the method further includes heating the slurry using the heating system as the slurry is being dispensed to the polishing pad prior to polishing the surface of the substrate with the slurry.

In some embodiments, the method further includes heating the polishing pad using the heating system prior to dispensing the slurry onto the polishing pad. In some embodiments, the method further includes controlling a temperature of the polishing pad by adjusting a location or a power of at least one heating element in the heating system.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A chemical mechanical polishing (CMP) system, comprising:

a polishing pad configured to polish a substrate;

a heating system configured to heat the polishing pad, wherein the heating system comprises a plurality of heating elements spaced apart from the polishing pad, the plurality of heating elements positioned on a side of the polishing pad around a perimeter of the polishing pad;

a sensor configured to measure a temperature of the polishing pad; and a controller configured to control a location of the plurality of heating elements.

2. The CMP system of claim 1, wherein the heating system is free from physical contact with the polishing pad.

3. The CMP system of claim 1, wherein the plurality of heating elements is evenly spaced apart from each other around the perimeter of the polishing pad.

4. The CMP system of claim 1, wherein at least one heating element of the plurality of heating elements comprises a plurality of heating lamps over a support plate.

5. The CMP system of claim 4, wherein the support plate is square shaped or circular shaped.

6. The CMP system of claim 4, wherein at least one heating lamp of the plurality of heating lamps is a ceramic lamp or a quartz lamp.

7. The CMP system of claim 1, wherein the plurality of heating elements is arranged in a circular configuration around the perimeter of the polishing pad.

8. The CMP system of claim 7, wherein the plurality of heating elements is evenly spaced apart from each other around the perimeter of the polishing pad.

9. The CMP system of claim 1, wherein the heating system further comprises at least one heating element positioned above the polishing pad.

10. A chemical mechanical polishing (CMP) system, comprising:

a polishing head configured to hold a substrate during a CMP process;

a polishing pad configured to polish the substrate;

a slurry delivery system configured to supply a slurry to the polishing pad;

a heating system configured to heat at least one of the polishing pad and the slurry, wherein the heating system comprises a plurality of heating elements each of which is spaced apart from the polishing pad by a distance, the plurality of heating elements being arranged in a circular configuration around a perimeter of the polishing pad;

a sensor configured to measure a temperature of the polishing pad; and a controller configured to control the plurality of heating elements in the heating system based on information received from the sensor.

11. The CMP system of claim 10, wherein the heating system is configured to heat the at least one of the polishing pad and the slurry through infrared radiation.

12. The CMP system of claim 10, wherein the distance between the polishing pad and the heating system is from about 10 mm to about 500 mm.

13. The CMP system of claim 10, wherein each of the plurality of heating elements is free from physical contact with the polishing head and the polishing pad.

14. The CMP system of claim 10, wherein the controller is configured to control a location of at least one heating element of the plurality of heating elements.

15. A method of controlling a temperature of a chemical mechanical polishing (CMP) process, comprising:

dispensing a slurry onto a polishing pad;

polishing a surface of a substrate with the slurry;

heating the polishing pad as the surface of the substrate is being polished, wherein the polishing pad is being heated through radiant heating using a heating system that is spaced apart from the polishing pad by a distance;

monitoring a temperature of the polishing pad;

controlling the temperature of the polishing pad by adjusting the distance between at least one heating element in the heating system and the polishing pad as the surface of the substrate is being polished; and maintaining the temperature of the polishing pad around a target temperature associated with one or more materials being polished.

16. The method of claim 15, further comprising heating the slurry using the heating system as the slurry is being dispensed to the polishing pad and the surface of the substrate is being polished with the slurry.

17. The method of claim 15, further comprising heating the substrate using the heating system as the surface of the substrate is being polished.

18. The method of claim 15, further comprising heating the slurry using the heating system as the slurry is being dispensed to the polishing pad prior to polishing the surface of the substrate with the slurry.

19. The method of claim 15, further comprising heating the polishing pad using the heating system prior to dispensing the slurry onto the polishing pad.

20. The method of claim 15, wherein polishing the surface of the substrate comprises:

polishing a surface of a conductive layer comprising a first metal at a first temperature; and polishing a surface of the conductive layer and a surface of a barrier layer comprising a second metal different from the first metal at a second temperature that is different from the first temperature, wherein controlling the temperature of the polishing pad comprises controlling the temperature of the polishing pad at the first temperature as the conductive layer is being polished and controlling the temperature of the polishing pad at the second temperature as the conductive layer and the barrier layer are being polished.

* * * * *